US011377807B2

(12) United States Patent
Lammers et al.

(10) Patent No.: US 11,377,807 B2
(45) Date of Patent: Jul. 5, 2022

(54) DEVICE FOR LEVELLING AN OFFSHORE FOUNDATION CONSTRUCTION

(71) Applicant: VALLOUREC DEUTSCHLAND GmbH, Dusseldorf (DE)

(72) Inventors: Andreas Lammers, Boulogne-Billancourt (FR); Daniel Stroetgen, Boulogne-Billancourt (FR); Till Koeder, Boulogne-Billancourt (FR); Stefan Bardenhagen, Boulogne-Billancourt (FR); Hans Pihl, Boulogne-Billancourt (FR); Niels Haakman, Boulogne-Billancourt (FR); Class Bruns, Boulogne-Billancourt (FR)

(73) Assignee: VALLOUREC DEUTSCHLAND GmbH, Dusseldorf (DE)

( * ) Notice: Subject to any disclaimer, the term of this patent is extended or adjusted under 35 U.S.C. 154(b) by 0 days.

(21) Appl. No.: 16/973,651

(22) PCT Filed: Jun. 18, 2019

(86) PCT No.: PCT/EP2019/066085
§ 371 (c)(1),
(2) Date: Dec. 9, 2020

(87) PCT Pub. No.: WO2019/243363
PCT Pub. Date: Dec. 26, 2019

(65) Prior Publication Data

US 2021/0246624 A1 Aug. 12, 2021

(30) Foreign Application Priority Data

Jun. 18, 2018 (EP) ..... 18178337

(51) Int. Cl.
*E02D 27/52* (2006.01)
*E02B 17/02* (2006.01)
(Continued)

(52) U.S. Cl.
CPC ..... *E02B 17/02* (2013.01); *E02D 5/72* (2013.01); *E02D 27/425* (2013.01); *E02D 27/52* (2013.01);
(Continued)

(58) Field of Classification Search
CPC ..... E02D 27/52; E02D 27/525; E02B 2017/0039; E02B 2017/0043;
(Continued)

(56) References Cited

U.S. PATENT DOCUMENTS 4,405,115 A * 9/1983 Boyadjieff ..... E02B 17/0854 254/106
4,674,920 A * 6/1987 Regan ..... E02B 17/00 405/227
(Continued)

FOREIGN PATENT DOCUMENTS

EP 0 053 861 A1 6/1982
GB 2 200 704 A 8/1988
(Continued)

OTHER PUBLICATIONS

International Search Report dated Sep. 5, 2019 in PCT/EP2019/066085 filed on Jun. 18, 2019.

*Primary Examiner* — Frederick L Lagman
(74) *Attorney, Agent, or Firm* — Oblon, McClelland, Maier & Neustadt, L.L.P.

(57) ABSTRACT

A device for levelling an offshore foundation construction including a cylinder equipped with a fastening member for removably fastening the cylinder to a part of the offshore foundation construction, a rod mobile in axial translation
(Continued)

Figure 1:
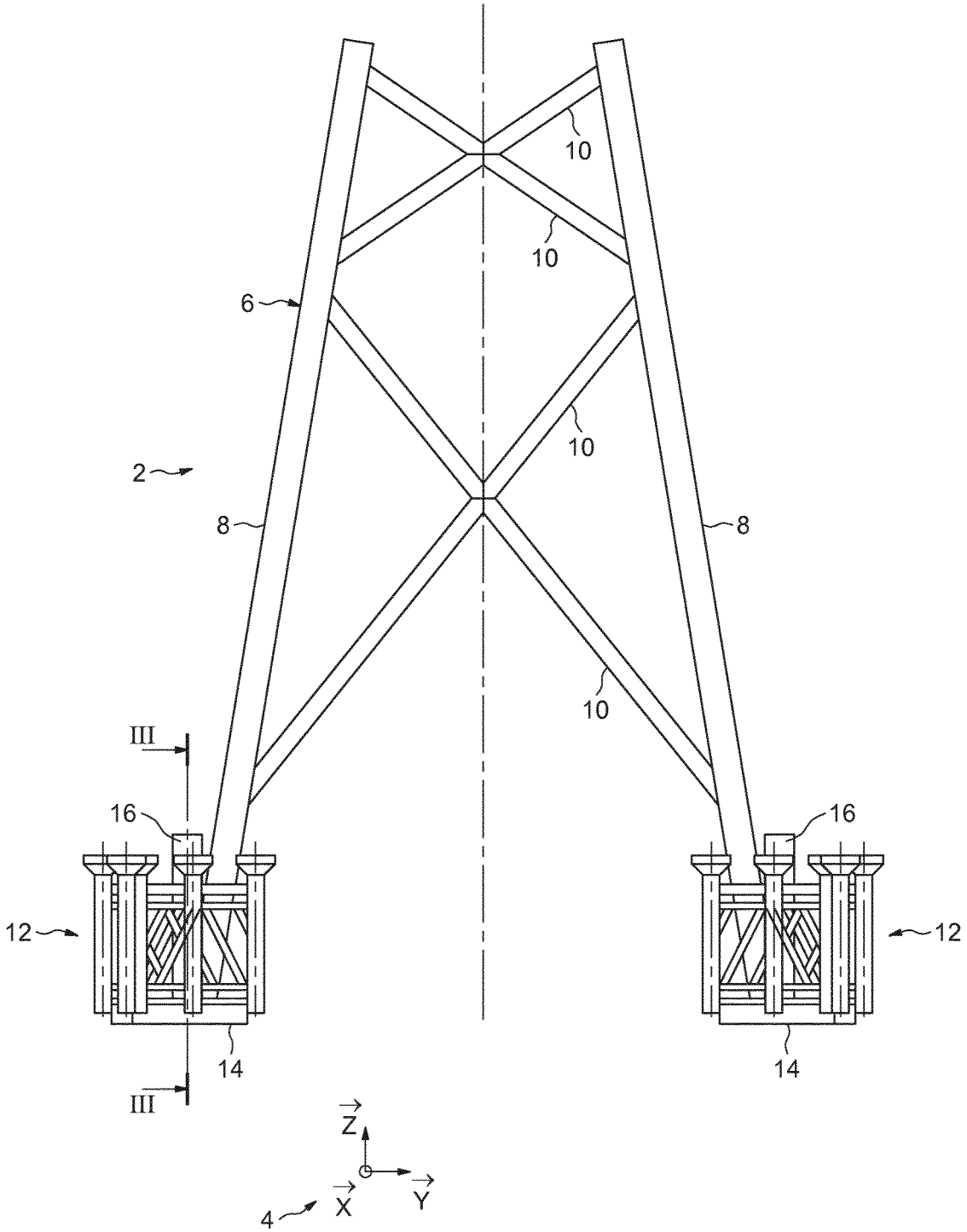

with respect to the cylinder, the rod including a pushing end so configured to push against a mudmat.

18 Claims, 5 Drawing Sheets

(51) Int. Cl.
*E02D 5/72* (2006.01)
*E02D 27/42* (2006.01)
*E02D 35/00* (2006.01)
*E02B 17/00* (2006.01)

(52) U.S. Cl.
CPC ..... *E02D 27/525* (2013.01); *E02D 35/00* (2013.01); *E02B 17/00* (2013.01); *E02B 2017/0082* (2013.01); *E02B 2017/0091* (2013.01); *E02D 2200/1685* (2013.01); *E02D 2200/1692* (2013.01)

(58) Field of Classification Search
CPC ..... E02B 2017/0056; E02B 2017/0073; E02B 2017/0082; E02B 17/02; E02B 17/021
USPC ..... 405/224, 227, 228
See application file for complete search history.

(56) References Cited

U.S. PATENT DOCUMENTS 4,720,214 A * 1/1988 Brasted ..... E02D 27/42 405/227
4,850,743 A * 7/1989 Hopper ..... E21B 43/017 405/190
5,163,783 A * 11/1992 Fahrmeier ..... E21B 43/017 166/338
5,573,355 A * 11/1996 Thomas ..... E02B 17/021 405/227
2010/0296875 A1* 11/2010 Thomson ..... E02B 17/025 405/224
2011/0139043 A1 6/2011 Reed
2011/0211915 A1 9/2011 Van Nood et al.
2011/0318113 A1 12/2011 Fraenkel

FOREIGN PATENT DOCUMENTS

GB 2467842 A 8/2010
GB 2551333 A * 12/2017 ..... E02D 27/12
WO WO 2009/017399 A1 2/2009
WO WO-2009044161 A2 * 4/2009 ..... E02B 17/025
WO WO 2009/155639 A1 12/2009
WO WO 2013/043055 A1 3/2013

* cited by examiner

DEVICE FOR LEVELLING AN OFFSHORE FOUNDATION CONSTRUCTION

The present invention relates to the technical field of offshore foundation constructions, in particular offshore foundation constructions intended to support an offshore wind turbine. More specifically, the invention relates to a device for levelling such an offshore foundation construction.

Offshore devices such as offshore wind turbines usually rest on an offshore foundation construction including a structure and foundation piles. The structure may include for instance a jacket or a tripod. The offshore foundation construction is arranged on a seabed. More specifically, the offshore foundation construction is secured to the seabed by the foundation piles driven into the seabed. An upper end of the foundation piles is connected to the structure. The offshore foundation construction is then firmly secured to the seabed and the offshore device may keep on operating properly while resisting to aggressive conditions such as a storm, an important stream or waves.

Below the structure, conventional offshore foundation constructions sometimes include a mudmat laying horizontally on the seabed. The mudmat aims at distributing the load on a large surface of the seabed. The mudmat can, for instance, consist of a metallic plate.

During installation of an offshore foundation construction, it is a thorny problem to level the offshore foundation construction that is to ensure that the orientation of the offshore foundation construction meets accurately with the design specifications.

One conventional solution for levelling an offshore foundation construction includes firstly performing installation of the offshore foundation structure, that is setting down the structure on the seabed and driving the foundation piles into the seabed. Secondly, this conventional method includes exerting a load on a part of the structure to level the structure. For instance, a lower corner of the structure may be pulled up. By doing so, the orientation and/or the position of the structure is modified.

Although such a solution allows levelling an offshore foundation structure, it is not fully satisfactory. Firstly, the effort exerted on the structure involves a risk of deforming and weakening the structure. Secondly, the effort to be exerted on the structure and foundation piles is extremely important due to the friction between the piles and the structure. Thirdly, an important effort is required for moving the offshore foundation construction together with the foundation piles. Those efforts may even induce a detrimental bending of the foundation piles.

One other conventional solution includes setting down a template structure that reproduces the bulk of the offshore foundation on the seabed, levelling the template structure, confirming the position of the piling sites and driving piles in said sites. Then, the conventional method includes removing the template structure and installing the offshore foundation structure.

This solution is also not fully satisfactory because the use and manipulations of a heavy template structure are both time consuming and costly.

The invention aims at overcoming the above-mentioned drawbacks. More specifically, the invention aims at allowing levelling an offshore foundation construction while decreasing the risk of deforming or weakening the structure as with the first conventional solution and also removes the need for the use of a template as with the other conventional solution.

According to a first aspect of the invention, it is proposed a device for levelling an offshore foundation construction, including a cylinder equipped with a fastening means for removably fastening the cylinder to a part of the offshore foundation construction, a rod mobile in axial translation with respect to the cylinder, the rod including a pushing end so configured to push against a mudmat.

The mudmat may be part of the offshore foundation construction.

Such a device allows levelling the offshore foundation construction prior to insertion of the foundation piles, preventing the structure to revert back into its original position and avoiding the use of a template structure. The risk of deforming or weakening the structure and/or the foundation piles is avoided.

According to an embodiment, the pushing end has a spherical shape, the curvature radius of the spherical shape of the pushing end being preferably within a range 450 mm to 1500 mm, more preferably within a range 1000 mm to 1500 mm.

Such a design of the pushing end, especially with a curvature radius within this range, is adapted to cooperate with a mudmat of an offshore foundation construction, in particular intended to support an offshore wind turbine.

According to another embodiment, the fastening means is configured for fastening the cylinder to a bearing part of the offshore foundation construction.

Preferably, the bearing part is a sleeve, the sleeve being part of a structure or of an adapter of the offshore foundation construction.

Advantageously, the sleeve is a cylinder having a circular radial cross section.

According to another embodiment, the fastening means includes at least two clamping chucks spread over the outer circumference of the cylinder.

Clamping chucks are particularly well adapted in the device according to the invention because it allows fastening remotely and firmly in a subsea environment.

According to an embodiment, the rod includes a cylindrical part having a circular radial cross section, the radius of the circular radial cross section being preferably within a range 450 mm to 1500 mm.

The so-designed rod is especially adapted for a device for levelling an offshore foundation construction intended to support an offshore wind turbine.

According to an embodiment, the device further includes a measurement system for measuring a displacement of the rod with respect to the cylinder, the measurement system including a first measurement unit arranged within the rod and/or a second measurement unit arranged within the cylinder.

The measurement system allows monitoring the levelling operation of the offshore foundation construction. If the measurement system includes both first and second measurement units, it is possible to perform a redundant measuring so as to increase the reliability of the levelling operation.

In another embodiment, the cylinder includes an upper frontal surface, the device including a connection part axially upwardly protruding from the upper frontal surface, the connection part being intended to accommodate a connection line, the connection part being able to be caught in order to remove the device from the offshore foundation construction.

In a more specific embodiment, the connection part includes a lower portion and an upper portion, the lower portion being cylindrical, the upper portion being frustoconical, the connection part including a bore extending inside the lower portion and the upper portion, the lower end of the upper portion having a larger radial cross-section than the radial cross-section of the lower portion.

Such a connection part is particularly well adapted for allowing a control line such as a guiding tool to be inserted within the bore. Furthermore, the connection part may be easily caught up by a catching apparatus so as to remove the device from the offshore foundation construction after the levelling operation.

In a possible embodiment, the mudmat may be secured to the rod. This embodiment enables handling of the mudmat and device together during positioning.

In another embodiment, the device includes a mudmat at least partially removably secured to the rod. This embodiment enables handling of the mudmat and device together during positioning while allowing to leave the mudmat in situ in case of need.

In yet another embodiment, the device includes a mudmat at least partially removably secured to the offshore foundation structure. This embodiment eases handling and positioning of the mudmat while allowing the levelling operation once positioned.

In a further embodiment, the device includes a mudmat made of several parts. This embodiment may ease installation, positioning or removal of the mudmat in some configurations of the offshore foundation construction.

According to another aspect of the invention, it is proposed an adapter for an offshore foundation construction including a device as set forth above.

In a specific embodiment, the adapter includes a central sleeve and a peripheral sleeve for insertion of a pile of the offshore foundation construction, the device being inserted within the central sleeve.

According to a further aspect of the invention, it is proposed an offshore foundation construction including a structure, a mudmat and a device as set forth above and/or an adapter as set forth above.

According to a further aspect of the invention, it is proposed a method of levelling an offshore foundation construction, preferably an offshore foundation construction intended to support an offshore wind turbine, including fastening a device as set forth above to a part of the offshore foundation construction, and actuating a motion of axial translation of the rod with respect to the cylinder so as to push against a mudmat of the offshore foundation construction.

It may also be foreseen that the steps of fastening and actuating are implemented prior to a step of inserting a first pile of the offshore foundation construction.

Figure 2:
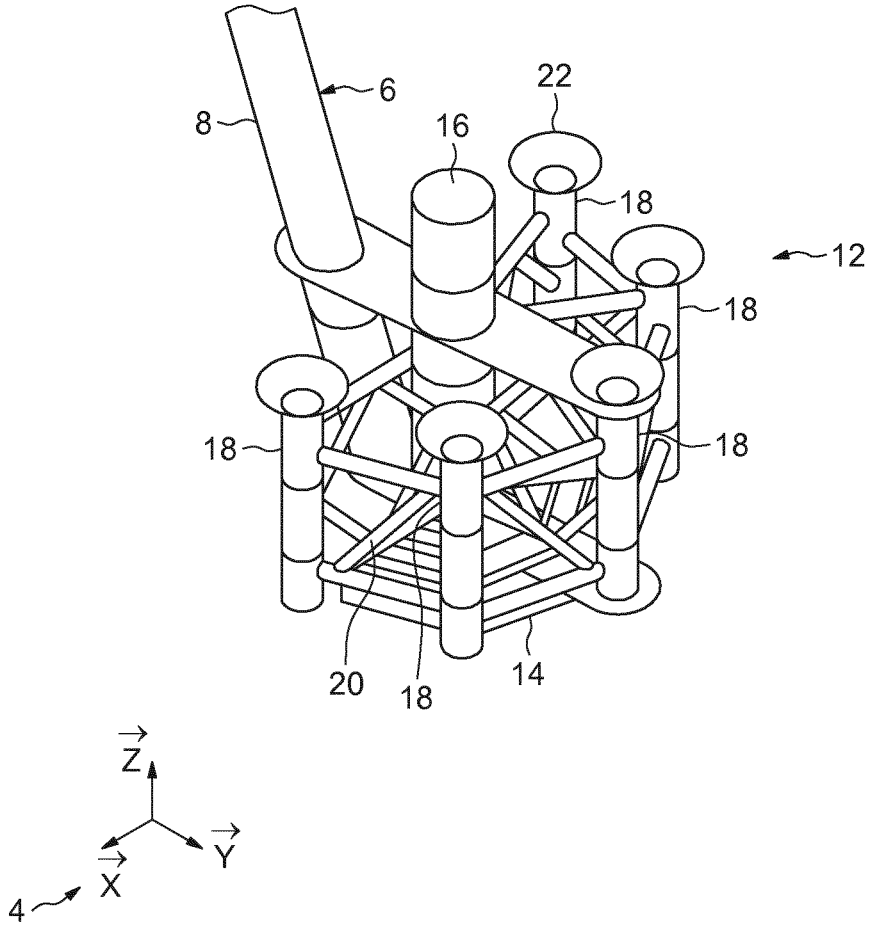
Figure 3:
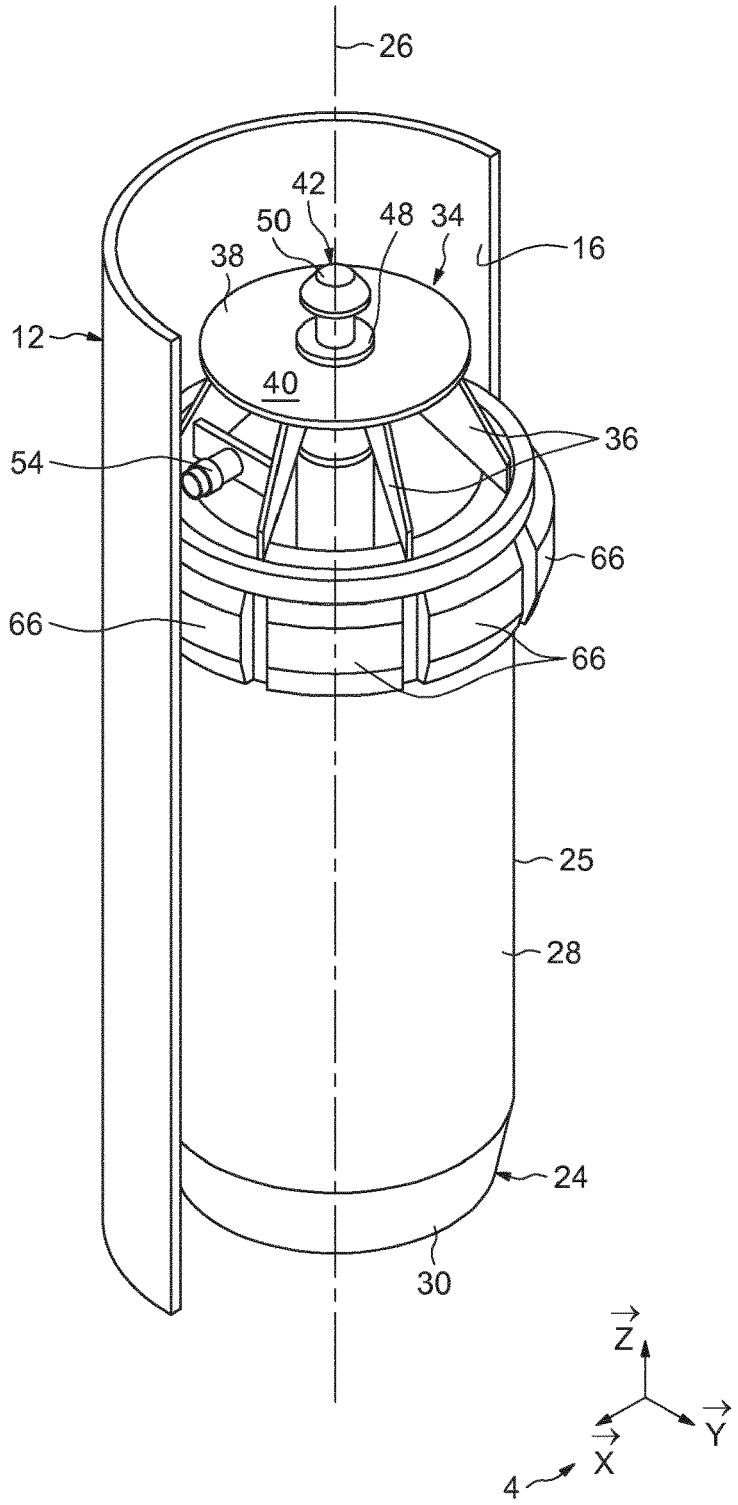
Figure 4:
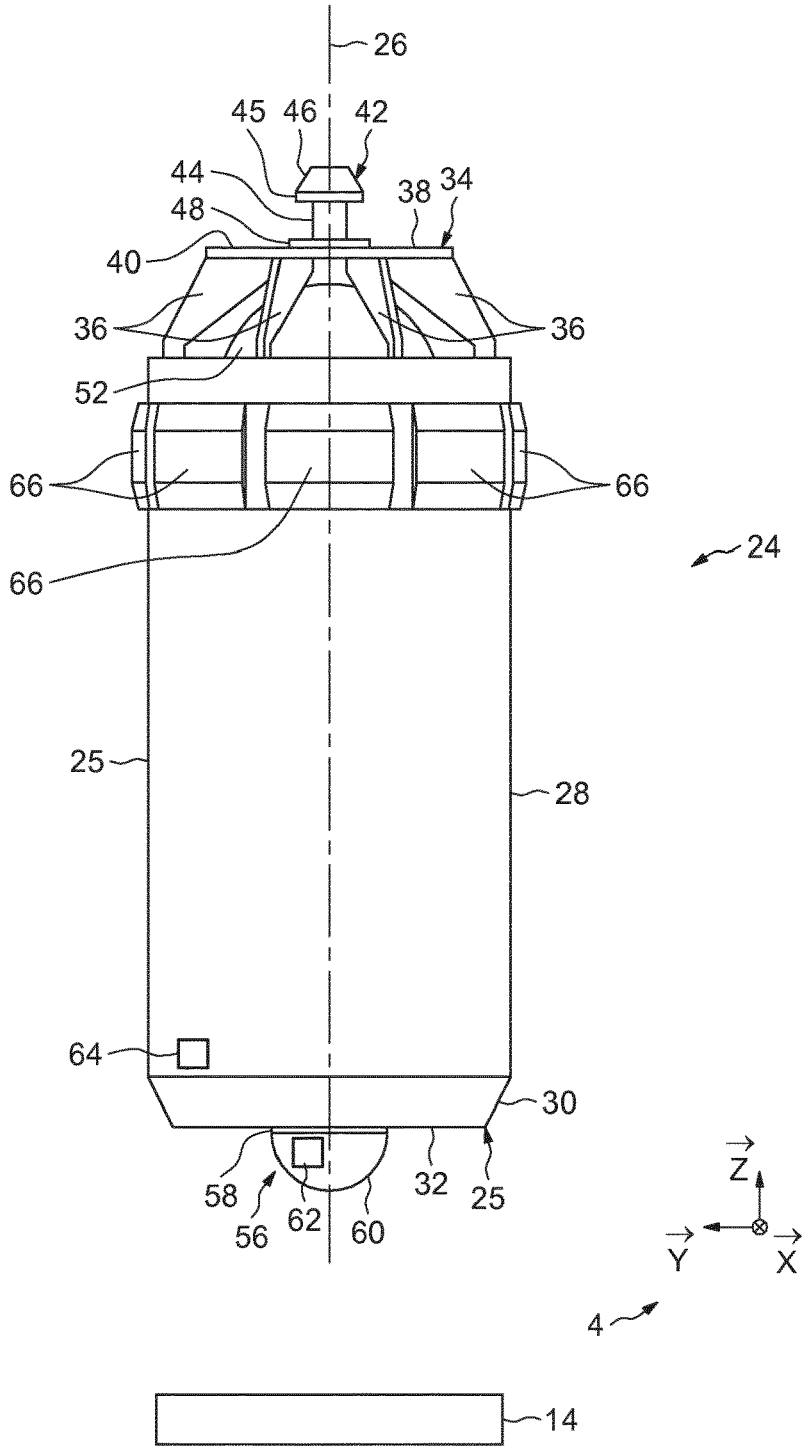
Figure 5:
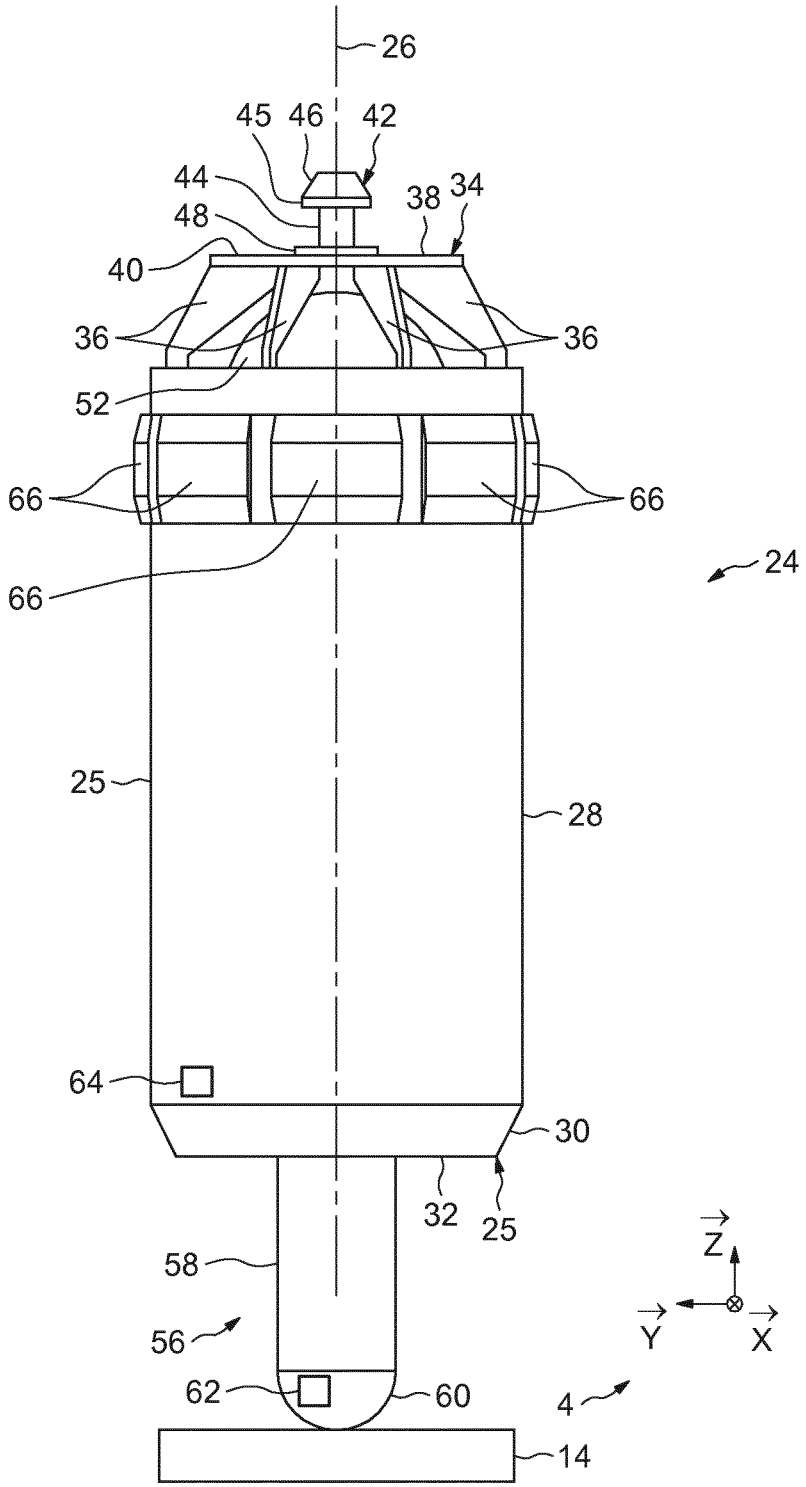

The present invention and its advantages will be better understood by studying the detailed description of a specific embodiment given by way of nonlimiting examples and illustrated by the appended drawings on which:

FIG. 1 is a side view of an offshore foundation construction according to one aspect of the invention, FIG. 2 is a isometric view of an adapter of the offshore foundation construction of FIG. 1, FIG. 3 is a isometric view of a first device embodiment for levelling the offshore foundation construction of FIG. 1, FIG. 4 is a side view of the device of FIG. 3 in a first configuration, and FIG. 5 is a side view of the device of FIG. 3 in a second configuration.

With reference to FIG. 1, it is schematically depicted an offshore foundation construction 2. The offshore foundation construction 2 aims at resting on a seabed (not depicted) and at supporting an offshore device (not depicted), in particular an offshore wind turbine. Nonetheless, the offshore foundation construction 2 may be used for supporting another kind of offshore device, such as an offshore hydrocarbon production platform.

It is defined an orthonormal direct vector base 4 attached to the offshore foundation construction 2. The base 4 consists of a vector $\vec{x}$, a vector $\vec{y}$ and a vector $\vec{z}$.

In the present application, terms "low", "down", "up", "horizontal" and "vertical" will be understood as referring relative to the base 4 when the offshore foundation construction 2 is normally installed on a horizontal seabed, that is assuming that the vector $\vec{z}$ is vertically upwardly directed.

As well, the word "cylindrical" will be understood according to its common definition, being namely that a cylindrical surface is a surface consisting of all the points on all the lines which are parallel to a given line and which pass through a fixed plane curve in a plane not parallel to the given line.

The offshore foundation construction 2 includes a structure 6. The structure 6 includes four main legs 8, only two legs 8 being visible on the side view of FIG. 1. The structure 6 also includes a plurality of braces 10. The braces 10 connect mechanically a leg 8 with another leg 8. On the side view of FIG. 1, only four braces 10 are visible.

In the depicted embodiment, the structure 6 is a jacket. However, it would be possible without departing from the scope of the invention to have a structure having a different design, being for instance a tripod.

The offshore foundation construction 2 includes, for each main leg 8, an adapter 12. That is, in the embodiment of FIG. 1, the offshore foundation construction 2 includes four adapters 12, only two of them being visible on the side view of FIG. 1. For each main leg 8, an adapter 12 is attached to a lower end of the main leg 8. In the depicted embodiment, the adapters 12 are welded to the legs 8 before that the offshore foundation construction 2 is launched in the sea.

As visible on FIG. 1, each adapter 12 is associated with a mudmat 14. For each adapter 12, the mudmat 14 is an independent part and is arranged to rest on top of the seabed. The adapter 12 is arranged above the mudmat 14. The mudmat 14 may be made of a material including concrete and/or steel and/or composites.

With reference to FIG. 2, the adapter 12 includes a central sleeve 16 and five peripheral sleeves 18. In the embodiment illustrated in FIG. 2, the sleeves 16 and 18 are cylindrical about the direction of the vector $\vec{z}$. The sleeves 16 and 18 may optionally be tilted with respect to the vector z. Nonetheless, possible variations of the invention may comprise a different number of peripheral sleeves 18 and/or a different geometrical arrangement of peripheral sleeves 18. The sleeves 18 are all located on a circle about the axis of the sleeve 16. The sleeve 16 and the sleeves 18 have a circular radial cross-section. The diameter $d_{18}$ of the radial cross section is substantially the same for all the sleeves 18. The diameter $d_{16}$ of the radial cross section of the sleeve 16 is approximately twice the diameter $d_{18}$:

$$1{,}0\times d_{18}<d_{16}\leq 3{,}0\times d_{18}$$

Each adapter 12 includes a metallic subframe 20. The metallic subframe 20 includes a plurality of metallic hollow sections (not referenced) and metallic plates (not referenced). For each adapter 12, the metallic subframe 20 aims at connecting the sleeve 16, the sleeves 18 and a joining portion for attaching the adapter 12 with a lower end of the main leg 8.

As visible on FIG. 2, each sleeve 18 includes an upper portion 22. For each sleeve 18, the portion 22 is frustoconical about the axis of the peripheral sleeve 18. More specifically, the portion 22 vertically extends between a lower circular end with a diameter $d_{22d}$ and an upper circular end with a diameter $d_{22u}$. The diameter $d_{22d}$ equals the diameter $d_{18}$ and the diameter $d_{22u}$ is larger than the diameter $d_{22d}$:

$$d_{22d}=d_{18}$$

$$2\times d_{22d}<d_{22u}\leq 3\times d_{22d}$$

Preferably, the angle of the frustoconical shape of the portion 22 is within a range 40° to 55°. The frustoconical shape of the portion 22 helps inserting a foundation pile in a sleeve 18 in order to secure the offshore foundation construction 2 to the seabed. The central sleeve 16 is located above the mudmat 14. The peripheral sleeves 18 are offset with respect to the mudmat 14.

With reference to FIG. 3, the adapter 12 is depicted in partial cross-section relative to the plane III-III. The plane III-III is perpendicular to the vector $\vec{y}$ and includes the axis of revolution of the sleeve 16. As may be seen on FIG. 3, the sleeve 16 contains a device 24. Unlike the adapter 12, the device 24 is not represented in cross-section on FIG. 3. The device 24 is also depicted on the side view of FIG. 4. The device 24 aims at allowing to level the offshore foundation construction 2.

The device 24 includes a cylinder 25. The cylinder 25 forms substantially a cylinder of revolution about an axis 26. Unless contrary indication, the words "axial", "axially", "radial", "radially" will be understood as referring relative to the axis 26. The axis 26 is parallel to the vector $\vec{z}$ and matches with the axis of revolution of the sleeve 16.

The cylinder 25 includes a central portion 28. The portion 28 is cylindrical with a circular radial cross-section about the axis 26. The diameter $d_{28}$ of the radial cross-section of the portion 28 is slightly smaller than the diameter $d_{16}$.

The cylinder 25 includes a lower portion 30. The portion 30 extends axially between the portion 28 and a lower frontal surface 32. The portion 30 is frustoconical about the axis 26. More specifically, the portion 30 is axially, upwardly delimited by an upper circular end having a diameter $d_{30}$. As the opposite end, the surface 32 forms a circle about the axis 26 having a diameter $d_{32}$. The diameter $d_{30}$ is generally larger than the diameter $d_{32}$ or equal:

$$d_{30}\times 0{,}75<d_{32}\leq d_{30}$$

The device 24 includes an upper cap 34. The cap 34 includes a plurality of vertical walls 36, for instance six vertical walls 36. The walls 36 are attached by their lower end to the portion 28. The walls 36 are attached by their upper end to a horizontal upper wall 38. The wall 38 is axially upwardly delimited by an upper frontal surface 40. In view of the foregoing, the cylinder 25 extends axially between the frontal surfaces 32 and 40.

With reference to FIGS. 3 and 4, the device 24 includes a connection part 42. The part 42 includes a lower portion 44, a central portion 45 and an upper portion 46. The portions 44 and 45 are cylindrical with a circular radial cross-section about the axis 26. The diameter $d_{44}$ of the radial cross-section of the portion 44 is smaller than the diameter $d_{45}$ of the radial cross-section of the portion 45.

The portion 46 is frustoconical about the axis 26. More specifically, the portion 46 extends axially between an upper circular end having a diameter $d_{46u}$ and a lower circular end having a diameter $d_{46d}$. The diameter $d_{46u}$ is smaller than the diameter $d_{46d}$ and the diameter $d_{46d}$ equals the diameter $d_{45}$.

The part 42 extends axially, upwardly from the surface 40. More specifically, the connection part 42 is mechanically secured to the wall 38 by means of a collar 48. By virtue of this arrangement, the part 42 forms a hook that can be caught by a catching apparatus (not depicted).

As may be seen on FIG. 3, the part 42 includes a through bore 50. The bore 50 is cylindrical with a circular radial cross-section about the axis 26. The diameter $d_{50}$ of the radial cross-section of the bore 50 is smaller than the diameters $d_{44}$ and $d_{46u}$.

Axially, the bore 50 extends on the whole axial length of the part 42. In other words, the bore 50 extends axially through the portions 44, 45 and 46. The bore 50 can accommodate at least one connection line (not depicted). The connection lines are intended to connect the device with various devices so as to provide a fluid connection, electrical connection, data connection, etc. For instance, the connection lines accommodated in the bore 50 may include guiding tools, fluid hoses, control lines, and data transfer cables. Typically, the bore 50 may be used for accommodating an umbilical with its connector.

With reference to FIG. 4, the device 24 includes a hydraulics system 52. The hydraulics system 52 aims at generating a hydraulic force by means of a hydraulic fluid which may be, for instance, oil or water.

With reference to FIG. 3, the hydraulics system 52 includes a hot stab 54. The hot stab 54 allows connecting a hydraulic duct (not depicted) to the hydraulics system 52. Using a hot stab 54 is advantageous because it renders the hydraulic fluid connection reliable in a submarine environment.

With reference to FIG. 4, the device 24 includes a rod 56. Only a portion of the rod 56 is visible on FIG. 4, a significant part of the rod 56 being hidden by the cylinder 25. On FIG. 5, the rod 56 has been displaced downwards with reference to the cylinder 25. The rod 56 includes a cylindrical part 58 and a hemispheric part 60. The part 58 is proximal with respect to the cylinder 25 whereas the part 60 is distal with respect to the cylinder 25. The part 58 is cylindrical with a radial circular cross-section about the axis 26. The radius $d_{58}$ of the radial cross-section of the part 58 is within a range 450 mm to 1500 mm. The part 60 is connected by an upper flat surface to a lower frontal surface of the part 58. The radius $r_{60}$ of the hemispheric part 60 is within a range 450 mm to 1500 mm, preferably a range 1000 mm to 1500 mm.

The rod 56 is mobile in axial translation about the direction of the vector $\vec{z}$ with respect to the cylinder 25. The translation motion of the rod 56 is actuated by a hydraulic force generated by the hydraulics system 52. More specifically, the rod 56 is driven axially downwards with respect to the cylinder 25 when a hydraulic force is generated by the hydraulics system 52 into the rod 56 (see FIG. 5). By doing so, the cylinder 25 and the rod 56 form together a piston and the hemispheric part 60 forms a pushing end so arranged to push against the mudmat 14 associated with the adapter 12 containing the device 24. Instead of the hemispheric part 60, the distal part of the rod may include a universal joint with a first side of the joint connecting the lower frontal surface of the part 58 and a second side of the joint providing a flat foot arranged so as to rest on the mudmat 14.

The device 24 includes a first measurement unit 62 and a second measurement unit 64. The units 62 and 64 have a communication link with a control unit (not depicted) of the device 24. The units 62 and 64 are able to measure the relative displacement of the rod 56 with respect to the cylinder 25. The unit 62 is arranged inside the rod 56. The unit 64 is arranged within the cylinder 25.

With reference to FIGS. 3 to 5, the device 24 includes eight clamping chucks 66 spread about the axis 26 on the outer circumference of the portion 28. More specifically, the clamping chucks 66 are able to move, with respect to the cylinder 25, in radial translation. The radial translation of the clamping chucks 66 is actuated by a hydraulic force generated by the hydraulics system 52. More specifically, the clamping chucks are radially, outwardly driven with respect to the cylinder when a hydraulic force is generated by the hydraulics system 52 into the clamping chucks 66.

By virtue of this arrangement, the clamping chucks 66 are able to exert a normal effort on the inner cylindrical surface of the sleeve 16. When such a normal effort is exerted, the clamping chucks 66 grip the sleeve 16 so as to form fastening means of the device 24 to the adapter 12.

In the depicted embodiment, the clamping chucks 66 are intended to fasten the cylinder 25 to the adapter 12. Nonetheless, it may be foreseen a different fastening of the cylinder 25 to the offshore foundation construction 2 without departing from the scope of the invention. For instance, it may be provided a fastening means of the cylinder 25 to a steel beam of the structure 6.

In order to level the offshore foundation construction 2, the adapters 12 are firstly welded to the legs 8. Such a welding operation is for instance implemented on dry dock.

Secondly, the devices 24 are inserted in the central sleeves 16 of the adapters 12, respectively. More specifically, in the described embodiment, at least three devices 24 are inserted on three out of the four sleeves 16. It may however be foreseen that a different number of devices 24 may be used, for example for safety reasons. The insertion of the devices 24 is facilitated by the frustoconical shape of the portion 30. Then, a hydraulic force is generated by the hydraulics system 52 into the clamping chucks 66. At the end of this step, the devices 24 are firmly attached to the adapters 12.

Once the devices 24 are fastened, the offshore foundation construction 2, including the structure 6, the four adapters 12 and the three devices 24, is launched in the water. Implementing the step of inserting the devices 24 prior to the step of launching the offshore foundation construction is advantageous since it reduces the number of steps to be implemented during an installation process of the offshore foundation construction 2. However, the steps of inserting and fastening the devices 24 and the step of launching the offshore foundation construction 2 may be inverted without departing from the scope of the invention.

Then, a control unit collects the information of the orientation of the offshore foundation construction 2. The control unit emits a corresponding correction signal. The correction signal includes a target signal for the displacement of the rod 56 of each device 24.

For each device 24, a hydraulic force is generated by the hydraulics system 52 into the rod 56. By doing so, the pushing end of the rod 56 pushes on the mudmat 14 facing the device 24 as depicted on FIG. 5. The adapter 12 associated with the device 24 is moved vertically so that the orientation of the structure 6 is modified.

During the step of generating a hydraulic force into the rod 56, the displacement can be monitored by the measurement system formed by the units 62 and 64. This allows the control unit to monitor the individual vertical displacement of each adapter 12 so as to monitor accurately the levelling of the offshore foundation construction 2.

When the levelling of the offshore foundation construction 2 is complete, foundation piles (not depicted) are inserted within the sleeves 18. The insertion of the foundation piles is facilitated by the frustoconical shape of the portions 22. The foundation piles are driven into the seabed by a hammering process or by any other suitable driving process. Once the foundation piles are inserted into the seabed, the hydraulics system 52 stops generating the hydraulic force into the rod 56.

Then, the hydraulic force exerted by the hydraulics system 52 into the clamping chucks 66 is relaxed. The devices 24 are caught up by a catching apparatus (not depicted) cooperating with the hook formed by the connection part 42. The devices 24 are then removed from the offshore foundation construction 2 and may be used for levelling another offshore foundation construction.

In view of the foregoing, the invention allows to level the offshore foundation construction 2 while decreasing the risk of deforming or weakening the structure 6 and/or the foundation piles. Furthermore, the levelling efforts are importantly reduced because the foundation piles are inserted in the seabed after the process of levelling. The device for levelling is not cumbersome and the fact that it can be installed prior to immerse the offshore foundation construction decreases the number of steps of the installation process of the offshore foundation construction.

The invention claimed is:

1. A device for levelling an offshore foundation construction, including a cylinder equipped with a fastening means for removably fastening the cylinder to a part of the offshore foundation construction, a rod mobile in axial translation with respect to the cylinder, the rod including a pushing end so configured to push against a mudmat, and further including a measurement system for measuring a displacement of the rod with respect to the cylinder, the measurement system including a first measurement unit arranged within the rod and/or a second measurement unit arranged within the cylinder.

2. The device according to claim 1, wherein the pushing end has a spherical shape, a curvature radius ($r_{60}$) of the spherical shape of the pushing end being within a range of 450 mm to 1500 mm.

3. The device according to claim 1, wherein the fastening means is configured for fastening the cylinder to a bearing part of the offshore foundation construction.

4. The device according to claim 3, wherein the bearing part is a sleeve, the sleeve is being part of a structure or of an adapter of the offshore foundation construction.

5. The device according to claim 4, wherein the sleeve is a cylinder having a circular radial cross section.

6. The device according to claim 1, wherein the fastening means includes at least two clamping chucks spread over an outer circumference of the cylinder.

7. The device according to claim 1, wherein the rod includes a cylindrical part having a circular axial cross section, a radius ($d_{58}$) of the circular radial cross section being within a range of 450 mm to 1500 mm.

8. The device according to claim 1, wherein the cylinder includes an upper frontal surface, the device including a connection part axially upwardly protruding from the upper frontal surface, the connection part being intended to accommodate a connection line, the connection part being able to be caught in order to remove the device from the offshore foundation construction.

9. The device according to claim 8, wherein the connection part includes a lower portion and an upper portion, the lower portion being cylindrical, the upper portion being frustoconical, the connection part including a bore extending inside the lower portion and the upper portion, the lower end of the upper portion having a larger ($d_{46d}$) radial cross-section than the radial cross-section ($d_{44}$) of the lower portion.

10. The device according to claim 1, further including a mudmat at least partially removably secured to the rod or to the offshore foundation construction.

11. The device according to claim 1, wherein the mudmat is made of several parts.

12. The device according to claim 1, wherein the mudmat is part of the offshore foundation construction.

13. The device according to claim 1, wherein the pushing end has a spherical shape, a curvature radius ($r_{60}$) of the spherical shape of the pushing end being within a range of 1000 mm to 1500 mm.

14. An adapter for an offshore foundation construction including the device according to claim 1.

15. The adapter according to claim 14, including a central sleeve and a peripheral sleeve for insertion of a pile of the offshore foundation construction, the device being inserted within the central sleeve.

16. An offshore foundation construction including a structure, a mudmat and the device and/or the adapter according to claim 14.

17. A method of levelling an offshore foundation construction, including fastening the device according to claim 1 to a part of the offshore foundation construction, and actuating a motion of axial translation of the rod with respect to the cylinder so as to push against a mudmat of the offshore foundation construction.

18. The method according to claim 17, wherein the steps of fastening and actuating are implemented prior to a step of inserting a first pile of the offshore foundation construction.

* * * * *